US009316960B2

(12) United States Patent
Kamoda et al.

(10) Patent No.: US 9,316,960 B2
(45) Date of Patent: Apr. 19, 2016

(54) FIXING DEVICE

(71) Applicant: Konica Minolta, Inc., Chiyoda-ku, Tokyo (JP)

(72) Inventors: Yuji Kamoda, Ibaraki (JP); Junya Hirayama, Takarazuka (JP); Shigeo Uetake, Takatsuki (JP); Tomohiko Masuda, Otsu (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/840,172

(22) Filed: Aug. 31, 2015

(65) Prior Publication Data

US 2016/0070212 A1 Mar. 10, 2016

(30) Foreign Application Priority Data

Sep. 6, 2014 (JP) ..... 2014-181797

(51) Int. Cl.
*G03G 15/20* (2006.01)

(52) U.S. Cl.
CPC ..... *G03G 15/2007* (2013.01)

(58) Field of Classification Search
CPC ..... G03G 15/2007; G03G 15/201; G03G 15/2039; G03G 15/2053; G03G 15/2042; G03G 2215/2006; H05B 6/145; H05B 6/80; H05B 1/0241
See application file for complete search history.

(56) References Cited

U.S. PATENT DOCUMENTS 6,461,782 B1 * 10/2002 Sasada ..... G03G 9/08791 430/108.1
8,606,165 B2 * 12/2013 Kovacs ..... G03G 15/2064 399/320
2004/0142263 A1 * 7/2004 Mikuriya ..... G03G 9/08755 430/108.2
2007/0280758 A1 * 12/2007 Ciaschi ..... G03G 9/0821 399/336
2010/0322685 A1 * 12/2010 Yamanouchi ..... G03G 15/6594 399/342
2013/0209150 A1 * 8/2013 Kamoda ..... G03G 15/2021 399/341
2014/0321892 A1 * 10/2014 Hirayama ..... G03G 15/11 399/328

FOREIGN PATENT DOCUMENTS

JP 2010-91627 A 4/2010
JP 2012-194339 A 10/2012

* cited by examiner

*Primary Examiner* — Francis Gray
(74) *Attorney, Agent, or Firm* — Buchanan Ingersoll & Rooney PC

(57) ABSTRACT

A fixing device includes: a non-contact heating portion that includes at least one non-contact heating unit which heats a toner image on a sheet; and a pressurizing and heating unit that is provided downstream in a sheet transport direction with respect to the non-contact heating portion and that pressurizes and heats the toner image. A time from a first point of time when the toner image reaches a toner melting temperature by heating of the non-contact heating portion to a second point of time when the toner image enters the pressurizing and heating unit is set equal to or more than a predetermined time. The predetermined time is a time when a ratio between the weight of the toner in the toner image before the entrance and the sum of the weight of the toner and the weight of the carrier liquid is equal to or more than 70%.

10 Claims, 7 Drawing Sheets

FIXING DEVICE

This application is based on Japanese Patent Application No. 2014-181797 filed on Sep. 6, 2014 the contents of which are hereby incorporated by reference.

BACKGROUND OF THE INVENTION

1. Field of the Invention

The present invention relates to a fixing device that is provided in a wet electrophotographic image forming device.

2. Description of the Related Art

In recent years, as an on-demand printing device or the like in which high quality and high resolution are required in commercial printing or the like, a wet electrophotographic method in which the particle diameter of toner is low and high-speed printing can be performed has been utilized. In the wet electrophotographic method, a wet developer (liquid developer) in which toner is dispersed in a carrier liquid is used, a toner image is transferred to a sheet and thereafter the toner image is fixed to the sheet with a fixing roller and the like.

The carrier liquid in a toner layer of the toner image acts so as to inhibit the production of internal cohesion of the toner layer. Hence, when the amount of carrier liquid in the toner layer is excessively large, an adhesive force between the toner and the fixing roller (pressurizing and heating unit) becomes greater than the internal cohesion of the toner layer or an adhesive force to the sheet, with the result that a so-called offset occurs in which the toner is moved to the fixing roller.

It can be considered that in order to cope with the offset described above, a non-contact heating portion is provided on the upstream side with respect to the fixing roller. The toner is melted in the non-contact heating portion, and thus the carrier liquid in the toner is pushed out to penetrate into the sheet, with the result that it is possible to reduce the amount of carrier liquid in the toner layer.

However, even when the carrier liquid is pushed out from the toner layer, if the toner image enters the fixing roller before the penetration of the carrier liquid becomes sufficient, the offset may be insufficiently reduced. In view of the foregoing problem, the present invention has an object to provide a fixing device in which the penetration of the carrier liquid is appropriately performed and with which it is possible to sufficiently reduce the offset.

SUMMARY OF THE INVENTION

According to the present invention, there is provided a fixing device that fixes, to a sheet, a toner image developed with a wet developer containing a toner and a carrier liquid, the fixing device including: a non-contact heating portion that includes at least one non-contact heating unit which heats the toner image on the sheet in a non-contact manner; and a pressurizing and heating unit that is provided on a downstream side in a sheet transport direction with respect to the non-contact heating portion and that pressurizes and heats the toner image on the sheet, where a time elapsed since the toner image reached a toner melting temperature by heating of the non-contact heating portion until the toner image enters the pressurizing and heating unit is a time when a ratio between a weight of the toner in the toner image before the entrance and a sum of the weight of the toner and the weight of the carrier liquid is equal to or more than 70%.

In the following description, the upstream side and the downstream side in the sheet transport direction are also simply referred to as the "upstream side" and the "downstream side".

More specifically, in the configuration described above, in the non-contact heating portion, a plurality of the non-contact heating units which output radiant energy for the non-contact heating may be provided so as to be aligned in the sheet transport direction, and an entrance direction in which the radiant energy output from each of focused heating units that are all or part of the non-contact heating units enters the sheet may be inclined to an upstream side in the sheet transport direction with respect to a direction vertical to the sheet.

More specifically, in the configuration described above, each of the focused heating units may be arranged to be inclined such that the direction of the output is inclined to the upstream side. More specifically, in the configuration described above, each of the focused heating units may include a heat source and a reflective plate that reflects radiant energy from the heat source, and the reflective plate of each of the focused heating units may be arranged to be inclined such that the direction of the output is inclined to the upstream side.

More specifically, in the configuration described above, a reflective plate corresponding to each of the focused heating units may be provided, and the reflective plate may be arranged so as to reflect, in a direction inclined to the upstream side, the radiant energy output from the corresponding focused heating unit.

More specifically, in the configuration described above, an angle between the entrance direction and the vertical direction in each of the focused heating units may be gradually decreased from the downstream side in the sheet transport direction toward the upstream side.

More specifically, in the configuration described above, at least one of angles between the entrance direction and the vertical direction in the focused heating units may be equal to or more than 10 degrees. More specifically, in the configuration described above, all the non-contact heating units may be the focused heating units.

More specifically, in the configuration described above, all the non-contact heating units other than the non-contact heating unit located in a most upstream position in the sheet transport direction may be the focused heating units. More specifically, in the configuration described above, in the non-contact heating unit located in the most upstream position in the sheet transport direction among the non-contact heating units, the direction of the output may substantially coincide with the vertical direction.

DESCRIPTION OF PREFERRED EMBODIMENTS

An embodiment of the present invention will be described below with reference to drawings. However, the details of the present invention are not limited to the embodiment.

[Basic Configuration and the Like of Image Forming Device]

Figure 1:
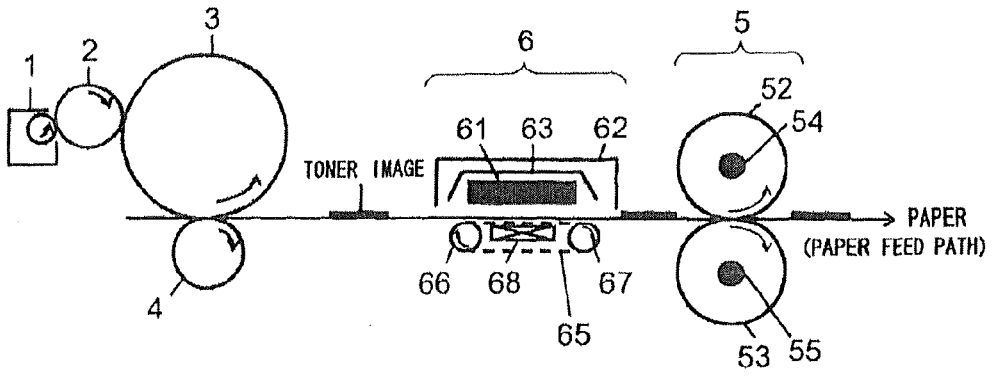
FIG. 1 A diagram showing the schematic configuration of an image forming device according to the present embodiment.

FIG. 1 is a diagram showing the schematic configuration of an image forming device according to the present embodiment. As shown in the figure, the image forming device includes a developing unit 1, a photosensitive member 2, an intermediate transfer member 3, a backup member 4, a fixing unit (pressurizing and heating unit) 5 and a non-contact heating portion 6. The non-contact heating portion 6 is arranged on the downstream side with respect to the intermediate transfer member 3 in a sheet transport direction, and the fixing unit 5 is arranged on the downstream side with respect to the non-contact heating portion 6.

The developing unit 1 uses a wet developer containing a toner and a carrier liquid to develop an electrostatic latent image on the photosensitive member 2 (photosensitive drum). A toner image that is formed on the photosensitive member 2 in this way and that is formed with the toner and the carrier liquid is transferred to the intermediate transfer member 3, is thereafter secondarily transferred by the backup member 4 from the intermediate transfer member 3 to a sheet and reaches the non-contact heating portion 6.

The non-contact heating portion 6 includes: a non-contact heater 61 that heats the image plane of the sheet in a non-contact manner, a heat-insulating cover 62 that covers parts of the non-contact heater 61 other than the side of the image plane; and a sheet transport unit that is arranged below in a vertical direction with respect to the paper feed path of the non-contact heater 61. The non-contact heater 61 is arranged within the heat-insulating cover 62, and the temperature of its surface is controlled to be the desired temperature by an unillustrated control unit.

With consideration given to the difference of light absorption between the toners of black, yellow, magenta and cyan and a non-image portion, as the non-contact heater 61, a non-contact heater using longer wavelengths is preferably used, and furthermore, with consideration given to a balance with an energy density, a ceramic heater, a halogen heater or the like is preferably used. On the upper portion of the non-contact heater 61, a reflective plate 63 for light collection is arranged in order to increase the efficiency of heating. As the reflective plate 63, aluminum or the like that is processed to have a mirror surface is preferably used.

As the heat-insulating cover 62 for maintaining the vicinity of the non-contact heater 61 at a high temperature, a high heat-insulating, high heat-resistant material such as a ceramic fiber is preferably used. In order to enhance the efficiency of volatilization of the carrier liquid, it is necessary to lower the saturated vapor pressure of the volatilized carrier liquid. Hence, immediately below the non-contact heater 61, an unillustrated air flow unit is preferably provided that discharges the volatilized carrier liquid (vapor) from the vicinity of the non-contact heater 61 to the outside.

In the present embodiment, as the sheet transport unit, a suction belt 65 is used. The suction belt 65 is arranged below in the vertical direction with respect to the paper feed path when seen from the non-contact heater 61, suction holes are provided in a high heat-resistant rubber material such as silicone rubber are provided and the suction belt 65 is wound around a drive roller 66 and a driven roller 67. The drive roller 66 is driven to rotate in a clockwise direction in FIG. 1 at a predetermined circumferential velocity with an unillustrated drive mechanism.

The drive roller 66 and the driven roller 67 are preferably formed with a metal roller such as aluminum, and the positional relationship in the sheet transport direction may be opposite. Within the suction belt 65 (between the drive roller 66 and the driven roller 67), a suction fan 68 is arranged, and the sheet that is transported is sucked.

In the non-contact heating portion 6, the toner image containing the carrier liquid and the sheet are heated mainly by radiation from the non-contact heater 61. Hence, the melting of the toner is facilitated, the carrier liquid in the toner layer is pushed out and the penetration into the sheet and the volatilization are facilitated. In the non-contact heating portion 6, as compared with the fixing unit 5, an open system is used, and a heating time is easily acquired, and thus the non-contact heating portion 6 is advantageous in the volatilization of the carrier liquid and the penetration into the sheet.

However, since in the non-contact heating, the thermal efficiency is relatively low, it is difficult to practically increase the toner image and the sheet at room temperature to an extremely high temperature, and the moisture volatilization is easily developed because the non-contact heating is advantageous in volatilization. Hence, in terms of the contraction of the sheet, it is desirable to prevent the temperature of the sheet from being increased to an extremely high temperature, and practically, penetration rather than volatilization is mainly performed on the carrier liquid. The toner image on the sheet is passed through the non-contact heating portion 6, and reaches the fixing unit 5.

In the fixing unit 5, a fixing roller 52 and a pressurization roller 53 are vertically aligned, and both end sides thereof are rotatably supported by unillustrated bearing members. A force acting in the direction of the rotation axis of the fixing roller 52 is applied to the pressurization roller 53 by an unillustrated pressurization mechanism using a spring or the like, and the pressurization roller 53 is pressed onto the lower surface portion of the fixing roller 52 with a predetermined pressure, with the result that a pressed nip portion is formed.

The unillustrated pressurization mechanism can be switched between pressing and separation. The pressurization roller 53 is driven to rotate in a clockwise direction indicated by an arrow at a predetermined circumferential velocity with an unillustrated drive mechanism. The fixing roller 52 is driven to rotate according to the rotation of the pressurization roller 53 by a pressurization friction force with the pressurization roller 53 at the pressed nip portion. By driving the fixing roller 52 to rotate, the pressurization roller 53 may be driven to rotate.

The fixing roller 52 and the pressurization roller 53 incorporate heater lamps (halogen lamps) 54 and 55, and the temperature of the surface is controlled to be the desired temperature by an unillustrated control unit. The fixing roller 52 and the pressurization roller 53 are a roller in which on the outer circumference of a hollow core (having a thickness of 0.5 to 5 mm) made of a metal, such as aluminum, that has a satisfactory thermal conductivity, a silicon rubber layer (having a thickness of 0.5 to 3 mm) serving as an elastic layer for acquiring a nip width and a mold release layer (for example, a fluorine-based resin mold release layer, such as PTFE or PFA, that has a thickness of 10 to 50 μm) for increasing the mold release property of the surface are provided.

The toner image containing the carrier liquid and the sheet are pressurized and heated by being pressed in the fixing unit 5. In this way, the melting of the toner is further facilitated, and the surface is smoothed. In the carrier liquid in the toner layer, the volatilization and the penetration into the sheet are further facilitated, and part thereof is removed by the fixing roller 52. The sheet is fed through the non-contact heating portion 6 and the fixing unit 5 described above, and thus the fixing quality is acquired.

The wet developer used in the present embodiment will then be described. As the carrier liquid of the wet developer, an insulating solvent is used. Examples of the insulating solvent can include isoparaffinic isopars (such as G, H, L and M) (Exxon Mobil Corporation), IP solvents (such as 1620, 2028 and 2835) (Idemitsu Kosan Co., Ltd.) and Paraffinic Moresco White (P-40, P-70 and P-120) (Matsumura Oil Research Corporation). It is also possible to use silicone oil or mineral oil.

The toner particle is mainly formed of a resin and a pigment or a dye for coloring. The resin has the function of uniformly dispersing the pigment or the dye in the resin and also has a function as a binder when it is fixed on a sheet or the like. As the resin, a thermoplastic resin such as a polystyrene resin, a polyurethane resin, an acrylic resin, a polyester resin, an epoxy resin, a polyamide resin, a polyimide resin or a polyurethane resin can be used. A plurality of types of these resins may be mixed and used.

As the pigment or the dye used for coloring the toner, a commercially available one can be used. For example, as the pigment, carbon black, red iron oxide, titanium oxide, silica, phthalocyanine blue, phthalocyanine green, sky blue, benzidine yellow, lake red D or the like can be used. As the dye, Solvent Red 27, Acid Blue 9 or the like can be used.

The volume average particle diameter of the toner appropriately falls within a range equal to or more than 0.1 μm but equal to or less than 5 μm. When the average particle diameter of the toner drops below 0.1 μm, the developing property is significantly lowered. On the other hand, when the average particle diameter exceeds 5 μm, the quality of the image is lowered. The ratio of the mass of the toner particles to the mass of the wet developer is appropriately about 10 to 50%.

When the ratio is less than 10%, the sedimentation of the toner particles easily occurs, and there is a problem in stability over time in long-term storage. In order to obtain a necessary image density, it is necessary to supply a large amount of developer, the amount of carrier liquid adhered on paper is increased and the amount of carrier liquid needed to be dried at the time of fixing is increased, with the result that necessary energy for fixing is inevitably increased. When the ratio exceeds 50%, the viscosity of the wet developer is excessively increased, and thus it is difficult to both manufacture and handle it. In the present embodiment, the volume average particle diameter is set at 2 μm, and the ratio of the mass of the toner particles to the mass of the wet developer is set at 30%.

As described above, in the present embodiment, in order to cope with the offset (the phenomenon in which the toner is moved to the fixing roller), the non-contact heating portion 6 is provided on the upstream side with respect to the fixing unit 5. However, as has already been described, even when the carrier liquid is pushed out from the toner layer by the action of the non-contact heating portion 6, if the toner image enters the fixing unit 5 before the carrier liquid sufficiently penetrates the sheet, the offset is insufficiently reduced.

The present inventors et al. have found from the evaluation of tests in examples and comparative examples which will be described later that it is important to acquire the time elapsed since the melting of the toner layer in the non-contact heating portion 6 until the toner image on the sheet is made to enter the fixing unit 5, that is, the penetration time during which the carrier liquid is made to penetrate the sheet. The effect of acquiring the penetration time is particularly remarkable on coated paper having a low liquid penetration. The examples and comparative examples will be described in detail below.

Examples 1 to 3

Figure 2:
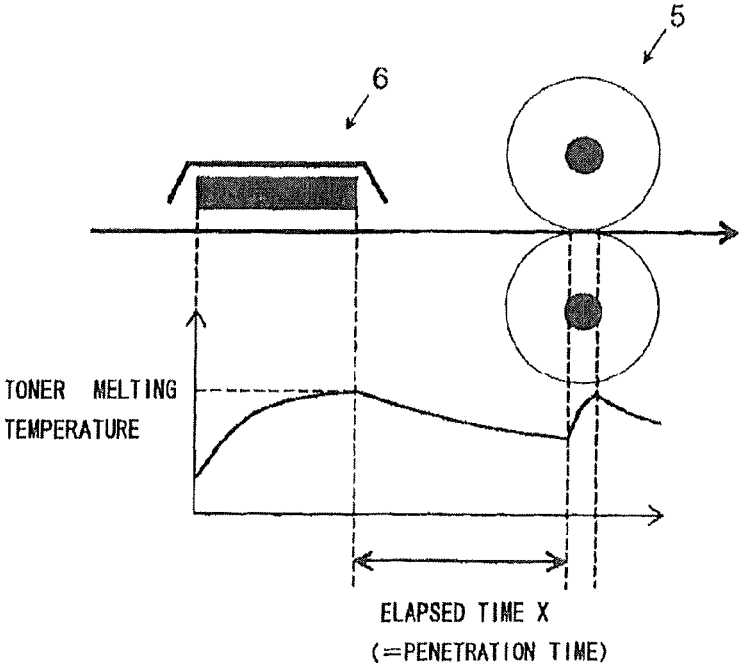
FIG. 2 A diagram illustrating the configuration of a device and the like common to examples 1 to 3 and comparative examples 1 to 9.

FIG. 2 shows the configuration of a fixing device (from a non-contact heating portion 6 to a fixing unit 5) common to examples 1 to 3 and comparative examples 1 to 9 and a profile of the toner temperature (sheet temperature) of a toner image on a sheet therein. The toner temperature is increased by heating after the toner image enters the non-contact heating portion 6 and reaches a toner melting temperature in front of the exit of the non-contact heating portion 6. After the toner image is fed out of the non-contact heating portion 6, while the temperature is lowered by discharge of heat, the toner image enters the nip portion of the fixing unit 5.

Thereafter, the toner image is pressurized and heated in the nip portion, and thus its temperature is increased. The toner image reaches the toner melting temperature in the non-contact heating portion 6, and thus the toner is melted to push out the carrier liquid, with the result that the penetration of the carrier liquid into the sheet is facilitated until the toner image enters the nip portion of the fixing unit 5.

Here, attention is focused on a relationship between a time elapsed (hereinafter also referred to as an "elapsed time X") since the toner image on the sheet reached the toner melting temperature until the toner image enters the nip portion of the fixing unit 5, the progress of a toner ratio Tc and an offset property (the degree of an offset). As the sheet, coated paper is applied, and the "toner ratio Tc" is assumed to be a value represented by formula (1) below.

$$Tc=(\text{toner weight})/\{(\text{toner weight})+(\text{carrier liquid weight})\} \quad (1)$$

In other words, the toner ratio Tc indicates the ratio of the toner weight to the sum of the toner weight and the carrier liquid weight, and as the toner ratio Tc (%) is increased, the ratio of the carrier liquid in the toner layer is decreased.

The toner ratio Tc can be measured as follows. A test patch (solid image) is formed on the sheet, the solid image after an arbitrary time has elapsed since the sheet was passed through the non-contact heating portion 6 (since the toner melting temperature was reached) is removed with a knife edge or the like and the measurement can be performed from variations in the mass of the solid image caused by drying. A graph of the results of a test for checking the relationship described above using a wet developer containing a certain type of toner (referred to as a toner A) is shown in FIG. 3.

As the offset property, the degree of the offset caused is evaluated with offset ranks 1 to 5. More specifically, in a downstream portion of the test patch (solid image) in the transport direction, a blank portion sufficiently longer than the circumferential length of the roller is provided, an image offset to the roller is retransferred to the blank and whether or not the retransferred toner is present and the amount of toner retransferred are ranked by sensitivity evaluation. Rank 5 indicates an evaluation result (the offset property: OK) in a proper state where the toner is not retransferred to the blank portion, and any of ranks 1 to 4 indicates an evaluation result (the offset property: No Good) in which the toner is retransferred to the blank portion and which is ranked by the amount of toner retransferred. As the amount of toner retransferred is increased, the rank is lowered (the number is decreased).

Figure 3:
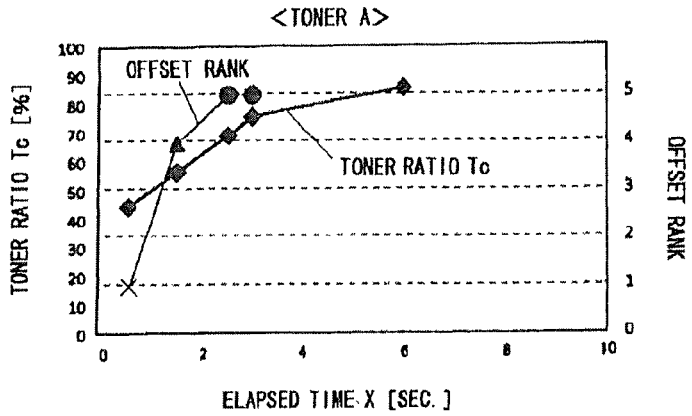
FIG. 3 A graph on the result of a test when a toner A is used.

As shown in FIG. 3, as the elapsed time X is increased, the penetration of the carrier liquid into the sheet is increased, and thus the toner ratio Tc is increased (the amount of carrier liquid in the toner layer is reduced). As the toner ratio Tc is increased, the internal cohesion of the toner layer is enhanced, and thus the offset rank is increased (the offset property is improved). It is found from the result shown in FIG. 3 that the offset rank where the offset property becomes proper is 5, that is, the toner ratio Tc where the offset property becomes proper is about 70%.

Figure 4:
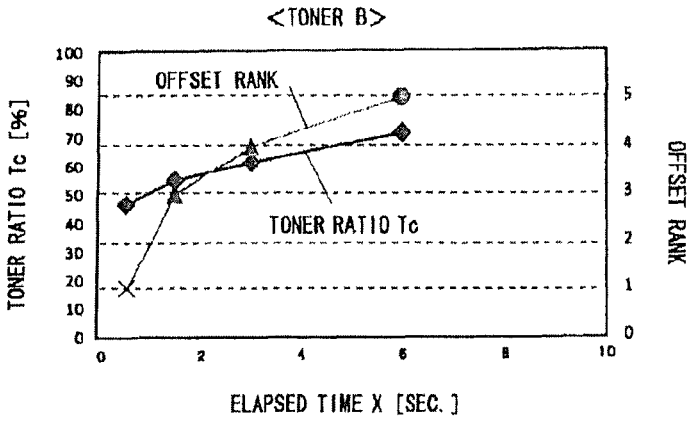
FIG. 4 A graph on the result of a test when a toner B is used.
Figure 5:
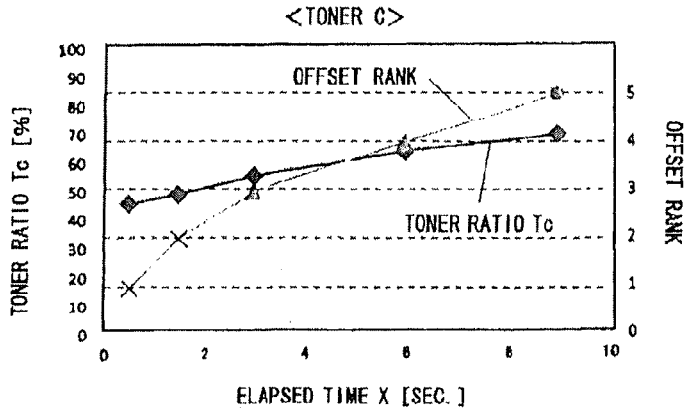
FIG. 5 A graph on the result of a test when a toner C is used.

Graphs of the results of tests for likewise checking the relationship described above using a wet developer containing two types of toners (referred to as a toner B and a toner C) different from the toner A are shown in FIG. 4 (in the case of the toner B) and FIG. 5 (in the case of the toner C). Likewise, as the sheet, coated paper is applied, and in any of the toners, the toner melting temperature is the same.

Likewise, in the cases of the toner B and toner C, as the elapsed time X is increased, the toner ratio Tc and the offset rank are increased. However, the gradient of the increase in the toner ratio Tc differs depending on the type of toner, and a formula of "the case of the toner A>the case of the toner B>the case of the toner C" holds true. Hence, for the elapsed time X necessary for achieving an offset rank of 5, a formula of "the case of the toner A<the case of the toner B<the case of the toner C" holds true.

The results of the evaluations of the tests on the toners A to C are collectively shown in Table 1. Example 1 is an example where in the toner A, the offset rank reached 5, example 2 is an example where in the toner B, the offset rank reached 5 and example 3 is an example where in the toner C, the offset rank reached 5. Comparative examples 1 and 2 are examples where in the toner A, the offset rank did not reach 5, comparative examples 3 to 5 are examples where in the toner B, the offset rank did not reach 5 and comparative examples 6 to 9 are examples where in the toner C, the offset rank did not reach 5. With respect to the evaluation of the offset, when the offset rank is 1 or 2, "X" is shown, when the offset rank is 3 or 4, "Δ" is shown and when the offset rank is 5, "○" is shown.

TABLE 1

| | Elapsed time X [Sec.] | Toner ratio Tc [%] | Offset | Type of toner |
|---|---|---|---|---|
| Comparative Example 1 | 0.5 | 44.7 | × | Toner A |
| Comparative Example 2 | 1.5 | 56.6 | Δ | |
| Example 1 | 2.5 | 69.3 | ○ | |
| Comparative Example 3 | 0.5 | 46.5 | × | Toner B |
| Comparative Example 4 | 1.5 | 54.9 | Δ | |
| Comparative Example 5 | 3 | 61.1 | Δ | |
| Example 2 | 6 | 71 | ○ | |
| Comparative Example 6 | 0.5 | 46 | × | Toner C |
| Comparative Example 7 | 1.5 | 49.2 | × | |
| Comparative Example 8 | 3 | 55.3 | Δ | |
| Comparative Example 9 | 6 | 63.5 | Δ | |
| Example 3 | 9 | 69 | ○ | |

It should be noted on the results described above that in any of the toners, the toner ratio Tc where the offset property is in the proper state (offset rank of 5) is substantially the same value of 70%. In other words, even when the ingredient of the increase in the toner ratio Tc after the melting temperature is reached differs depending on the type of toner, the toner ratio Tc where the offset property is in the proper state is substantially the same. Hence, it is found that it is important to set the elapsed time X such that the toner ratio Tc before the toner image enters the nip portion of the fixing unit 5 is equal to or more than 70%.

Figure 6:
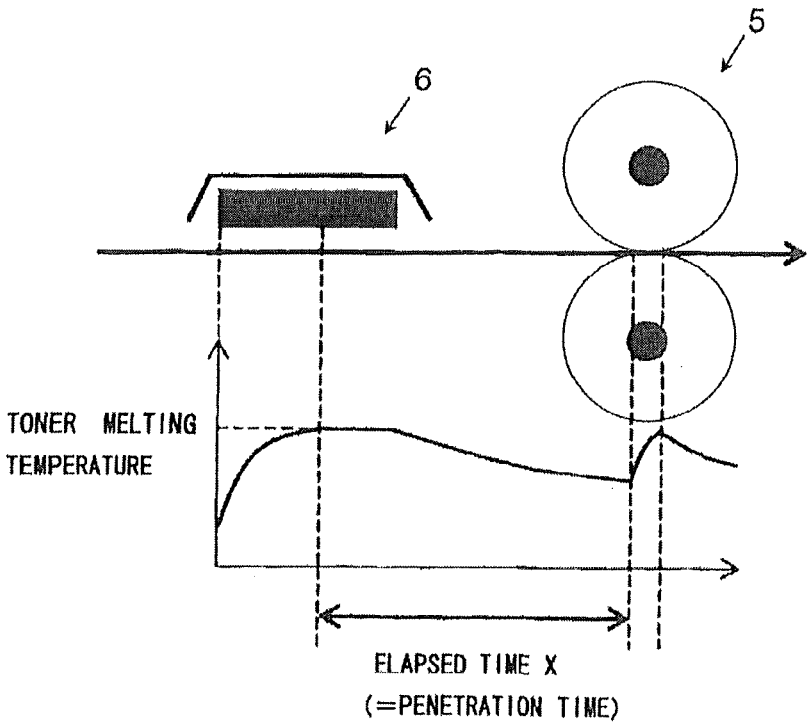
FIG. 6 A diagram illustrating an elapsed time X.

With respect to the elapsed time described above, the time elapsed since the toner melting temperature was reached until the toner image enters the nip portion of the fixing unit 5 is only important. Hence, in the case of the temperature setting of the non-contact heating portion 6 having a temperature profile in which as shown in FIG. 6, for example, halfway through the sheet transport in the non-contact heating portion 6, the toner melting temperature has already been reached, and in which within the non-contact heating portion 6, the toner melting temperature is maintained, a time elapsed not from the exit of the non-contact heating portion 6 but from the interior of the non-contact heating portion 6 where the toner melting temperature was reached is important.

Although as the toner melting temperature here, the melting temperature (so-called Tm or the like) of the toner, which is a physical property of the toner, is appropriate, a temperature lower than the temperature may be adopted. Even when the toner melting temperature is lower than the temperature Tm or the like, since the toner is melted, the effect of reduction (penetration) of the carrier liquid is produced. Even for the same toner, depending on the melting temperature, the necessary elapsed time X (penetration time) is changed. The value of the toner ratio Tc before the entrance into the nip portion of the fixing unit 5 is only important, and the elapsed time X corresponding to the melting temperature or the type of toner is preferably set such that the desired toner ratio Tc of 70% can be acquired.

As described above, in order to prevent the offset, it is preferable to set the elapsed time X such that the toner ratio Tc before the entrance into the nip potion of the fixing unit 5 is equal to or more than 70%, and with consideration given to the size of the device and the like, the distance from the non-contact heating portion 6 to the fixing unit 5 is preferably minimized. On the other hand, since the non-contact heating unit is low in thermal efficiency as compared with the pressurizing and heating unit such as the fixing unit, in order to achieve the desired paper temperature (the temperature of the toner image), a relatively high temperature of a heat source or a long heating time is needed.

In a case where the paper temperature is acquired by the temperature of the heat source, even when the heating time is extremely short, the temperature of the heat source is increased, and thus it is possible to achieve the desired paper temperature. However, as the temperature of the heat source is increased, a shift to the short wavelength side is produced, and thus the effect of a difference in light absorption rate caused by variations in the color of the toner (particularly, black) is inevitably increased. In other words, the difference in the temperature of the toner caused by variations in the color of the toner is increased, with the result that a difference in the quality of the fixing caused by variations in the color of the toner is disadvantageously increased and thus the possibility thereof is extremely low.

Hence, it is practical to acquire the paper temperature by the heating time. In order to acquire the heating time, that is, a heating distance in the transport direction, a multi-stage non-contact heating unit in which a plurality of non-contact heating units are aligned in the transport direction is advantageous. However, in the multi-stage non-contact heating unit, the non-contact heating units are simply aligned, and thus a paper temperature rise curve in the transport direction inevitably becomes broad. With consideration given to the acquisition of the penetration time (the elapsed time X described previously) of the carrier liquid, the effect on the size of the device and the like, it is preferable to rapidly increase the paper temperature (the toner temperature) on the most upstream side in the transport direction.

Examples 4 to 9

Examples (examples 4 to 9) where the configuration of the non-contact heating portion 6 and the like are designed such that an appropriate setting of the elapsed time X is easily performed will be described below by comparison with comparative example 10. In the following description, as the non-contact heater 61, a halogen lamp is adopted. Comparative example 10 will first be described.

Figure 7:
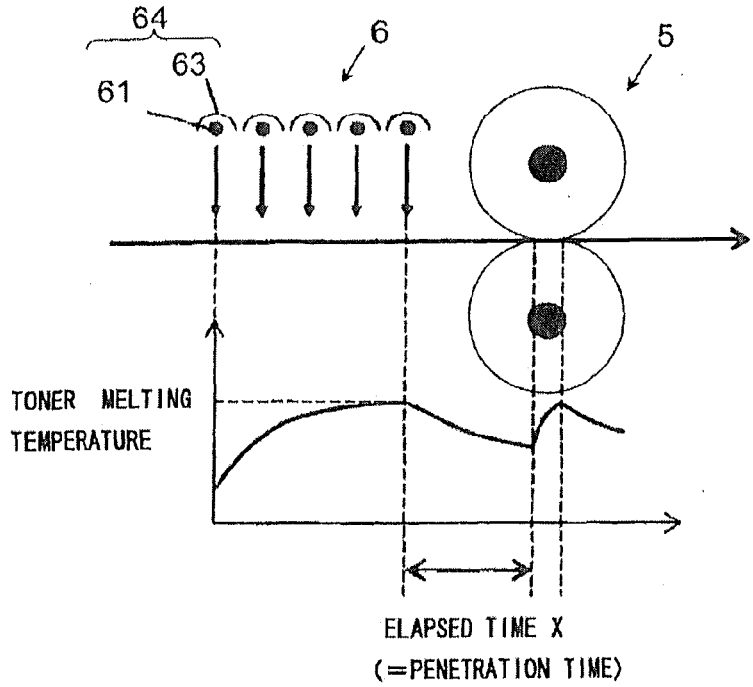
FIG. 7 A diagram illustrating the configuration of a device and the like in comparative examples 10.

FIG. 7 shows a configuration ranging from the non-contact heating portion 6 to the fixing unit 5 and a profile of the toner temperature (sheet temperature) in comparative example 10. The non-contact heating portion 6 in comparative example 10 is formed with a multi-stage non-contact heating unit that includes a total of five sets of non-contact heating units, each set consisting of one non-contact heater 61 and one reflective plate 63. Radiation from each of the non-contact heaters 61 is applied in a direction (hereinafter also simply referred to as a "vertical direction") vertical to the paper feed path parallel to the plane of the sheet transported. Hence, as shown in FIG. 7, the profile of the toner temperature (paper temperature) in the paper feed path is broad.

Figure 8:
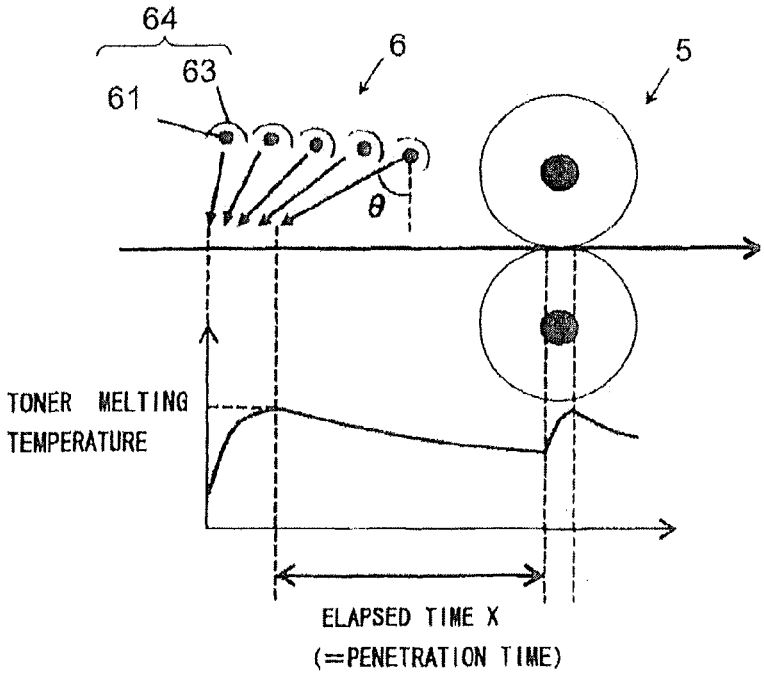
FIG. 8 A diagram illustrating the configuration of a device and the like in examples 4.

Example 4 will then be described. FIG. 8 shows a configuration ranging from the non-contact heating portion 6 to the fixing unit 5 and a profile of the toner temperature (sheet temperature) in example 4. In example 4, an infrared heater 64 consisting of the non-contact heater 61 and the reflective plate 63 is inclined to the upstream side in the sheet transport direction, and thus the direction of radiation (radiant energy for the non-contact heating) from each of the infrared heaters 64 is inclined to the upstream side with respect to the vertical direction directed from each of the infrared heaters 64 toward the paper feed path.

An angle θ shown in FIG. 8 indicates an angle between the vertical direction and the inclined direction. The angle θ is gradually decreased according to the arrangement toward the upstream side, and thus it is possible to rapidly increase the toner temperature (paper temperature) on the upstream side, with the result that it is possible to more acquire the elapsed time X (the penetration time). It is found that in example 4, as compared with comparative example 10, the distance from the non-contact heating portion 6 to the fixing unit 5 is equal but the elapsed time X (the penetration time) is dramatically prolonged.

When all the infrared heaters 64 are inclined to the upstream side at the same angle, though it is possible to more acquire the elapsed time X (the penetration time) without any change of the distance from the non-contact heating portion 6 to the fixing unit 5, there is a concern for an effect on a transfer portion depending on the angle, and the distance from the transfer portion to the non-contact heating portion 6 is inevitably prolonged depending on the situation. In order to reduce the entire size of the device, the present example is preferable where the light emitted from each of the infrared heaters 64 is concentrated to provide the rapid toner temperature (paper temperature) profile. In the present example, in order for a more practical effect to be obtained, the angle θ in one or a plurality of infrared heaters 64 is preferably set equal to or more than 10°.

Figure 9:
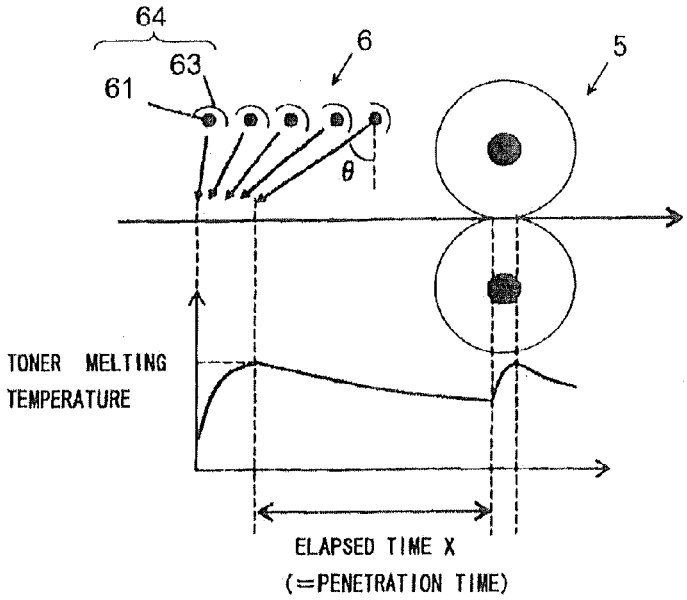
FIG. 9 A diagram illustrating the configuration of a device and the like in examples 5.

Example 5 will then be described. FIG. 9 shows a configuration ranging from the non-contact heating portion 6 to the fixing unit 5 and a profile of the toner temperature (sheet temperature) in example 5. In example 5, unlike example 4, as in comparative example 10, the non-contact heaters 61 are arranged in parallel to the paper feed path. However, the reflective plates 63 are inclined toward the upstream side, and thus the direction of radiation from each of the infrared heaters 64 is inclined to the upstream side with respect to the vertical direction directed from each of the infrared heaters 64 toward the paper feed path.

In the present example, as in example 4, it is possible to rapidly increase the toner temperature (paper temperature) on the upstream side, and thus it is possible to more acquire the elapsed time X (the penetration time). It is found that in example 4, as compared with comparative example 10, the distance from the non-contact heating portion 6 to the fixing unit 5 is equal but the elapsed time X (the penetration time) is dramatically prolonged.

Figure 10:
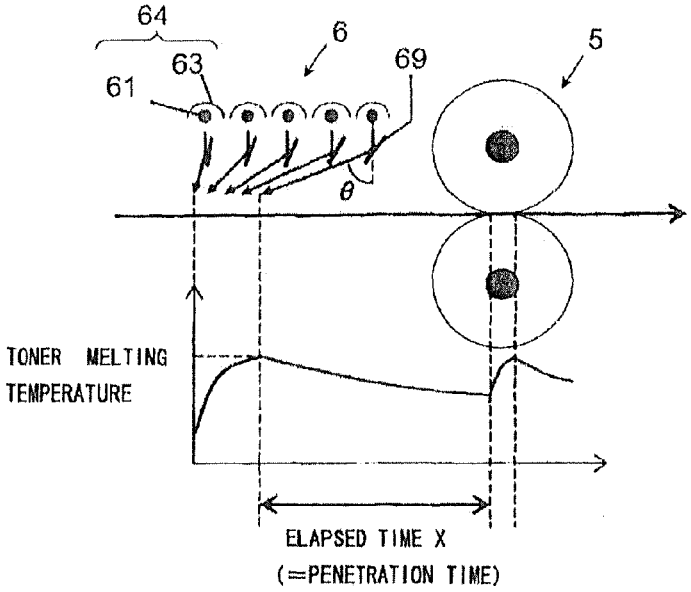
FIG. 10 A diagram illustrating the configuration of a device and the like in examples 6.

Example 6 will then be described. FIG. 10 shows a configuration ranging from the non-contact heating portion 6 to the fixing unit 5 and a profile of the toner temperature (sheet temperature) in example 6. In the present example, as in comparative example 10, the infrared heaters 64 are arranged in parallel to the paper feed path, and the direction of radiation from each of the infrared heaters 64 is the vertical direction. However, on the direction of travel of radiation from each of the infrared heaters 64, a reflective plate 69 is provided, and the radiation is reflected off the reflective plate 69, and thus the direction of the radiation is inclined to the upstream side with respect to the vertical direction (in other words, the reflective plates 69 are provided so as to perform such reflection).

In example 6, as in example 4, it is possible to rapidly increase the toner temperature (paper temperature) on the upstream side, and thus it is possible to more acquire the elapsed time X (the penetration time). It is found that in example 4, as compared with comparative example 10, the distance from the non-contact heating portion 6 to the fixing unit 5 is equal but the elapsed time X (the penetration time) is dramatically prolonged.

Figure 11:
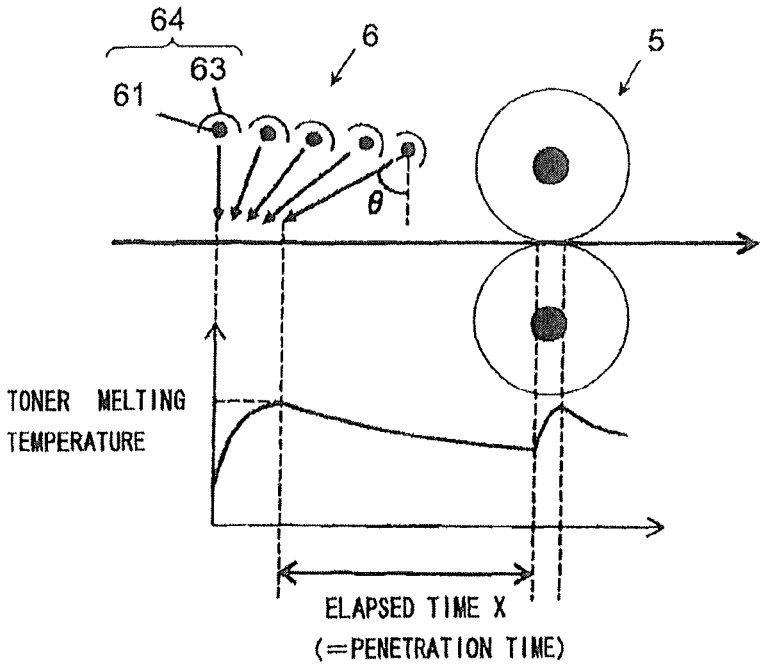
FIG. 11 A diagram illustrating the configuration of a device and the like in examples 7.

Example 7 will then be described. FIG. 11 shows a configuration ranging from the non-contact heating portion 6 to the fixing unit 5 and a profile of the toner temperature (sheet temperature) in example 7. The present example differs from example 4 in that in only the infrared heater 64 arranged in the most upstream position of the non-contact heating portion 6, radiation is applied toward the paper feed path in the vertical direction. In the other infrared heaters 64, light is applied to the downstream side with respect to the position immediately below the infrared heater 64 arranged in the most upstream position.

It cannot be said that example 7 is advantageous over example 4 in the acquisition of the elapsed time X (the penetration time). In other words, although in example 7, depending on the necessary elapsed time X (the penetration time), the distance from the non-contact heating portion 6 to the fixing unit 5 is inevitably increased as compared with example 4, it is possible to decrease the distance as compared with comparative example 10. In example 7, depending on the range of the necessary elapsed time X (the penetration time), it is possible to obtain a substantially equivalent effect to example 4.

Figure 12:
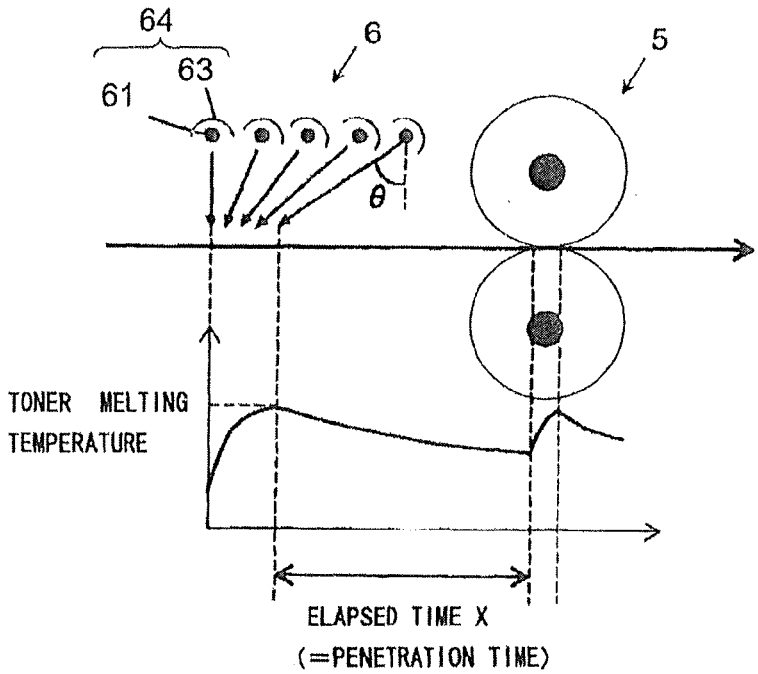
FIG. 12 A diagram illustrating the configuration of a device and the like in examples 8.

Example 8 will then be described. FIG. 12 shows a configuration ranging from the non-contact heating portion 6 to the fixing unit 5 and a profile of the toner temperature (sheet temperature) in example 8. The present example differs from example 5 in that in only the infrared heater 64 arranged in the most upstream position of the non-contact heating portion 6, radiation is applied toward the paper feed path in the vertical direction. In the other infrared heaters 64, light is applied to the downstream side with respect to the position immediately below the infrared heater 64 arranged in the most upstream position.

It cannot be said that example 8 is advantageous over example 5 in the acquisition of the elapsed time X (the penetration time). In other words, although in example 8, depending on the necessary elapsed time X (the penetration time), the distance from the non-contact heating portion 6 to the fixing unit 5 is inevitably increased as compared with example 5, it is possible to decrease the distance as compared with comparative example 10. In example 8, depending on the range of the necessary elapsed time X (the penetration time), it is possible to obtain a substantially equivalent effect to example 5.

Figure 13:
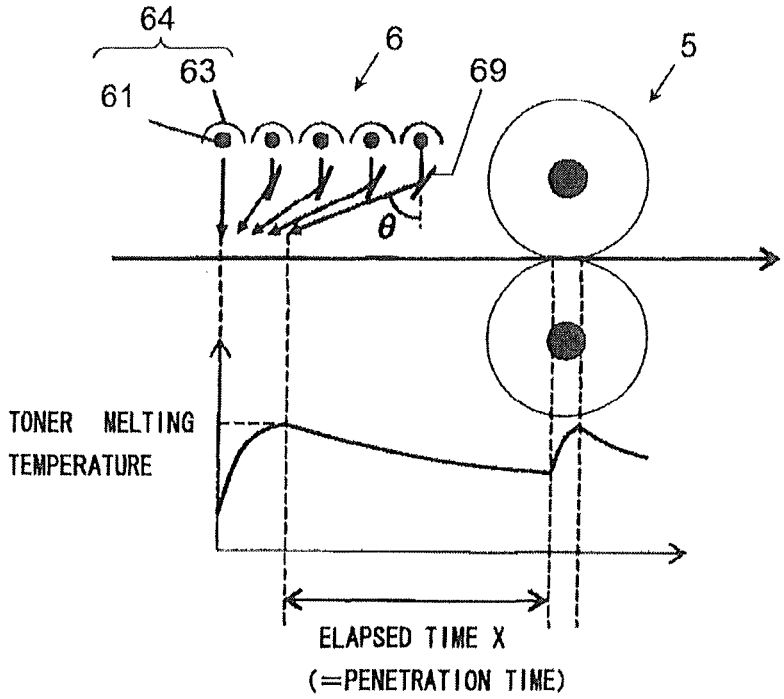
FIG. 13 A diagram illustrating the configuration of a device and the like in examples 9.

Example 9 will then be described. FIG. 13 shows a configuration ranging from the non-contact heating portion 6 to the fixing unit 5 and a profile of the toner temperature (sheet temperature) in example 9. The present example differs from example 6 in that in only the infrared heater 64 arranged in the most upstream position of the non-contact heating portion 6, radiation is applied toward the paper feed path in the vertical direction. In the other infrared heaters 64, light is applied to the downstream side with respect to the position immediately below the infrared heater 64 arranged in the most upstream position.

It cannot be said that example 9 is advantageous over example 6 in the acquisition of the elapsed time X (the penetration time). In other words, although in example 9, depending on the necessary elapsed time X (the penetration time), the distance from the non-contact heating portion 6 to the fixing unit 5 is inevitably increased as compared with example 6, it is possible to decrease the distance as compared with comparative example 10. In example 9, depending on the range of the necessary elapsed time X (the penetration time), it is possible to obtain a substantially equivalent effect to example 6.

The results of the tests using the toner A in examples 4 to 9 and comparative example 10 are collectively shown in table 2. Conditions and the like in the evaluation of the tests here are basically the same as in the evaluation of the tests in examples 1 to 3 described above. In any of examples 4 to 8, in the elapsed time X shown in table 2, the results in which the offset property was satisfactory ("○": the offset rank of 5) were obtained.

TABLE 2

| | Elapsed time X [Sec.] | Offset | Type of toner |
|---|---|---|---|
| Comparative Example 10 | 1.4 | Δ | Toner A |
| Example 4 | 3.1 | ○ | |
| Example 5 | 3.1 | ○ | |
| Example 6 | 3.1 | ○ | |
| Example 7 | 2.8 | ○ | |
| Example 8 | 2.8 | ○ | |
| Example 9 | 2.8 | ○ | |

[Overview]

The fixing device of the present embodiment is a fixing device that fixes, on the sheet, the toner image developed with the wet developer containing the toner and the carrier liquid, and is configured so as to have any one of the features of examples 1 to 9 described above or features corresponding to those features. The fixing device of the present embodiment includes: the non-contact heating portion 6 that has at least one non-contact heating unit which heats, in a non-contact manner, the toner image on the sheet transported to the downstream side; and the fixing unit 5 (pressurizing and heating unit) that is provided on the downstream side with respect to the non-contact heating portion 6 and that pressurizes and heats the toner image on the sheet.

In the fixing device of the present embodiment, the elapsed time X (the time elapsed since the toner image reached the toner melting temperature by the heating of the non-contact heating portion 6 until the toner image enters the fixing unit 5) is the time when the toner ratio Tc in the toner image before the entrance is equal to or more than 70%.

Information on the "time when the toner ratio Tc is equal to or more than 70%" and the like can be previously grasped by tests and the like in a design stage. In the fixing device of the present embodiment, based on the information and the like grasped in this way, a configuration, an operation and the like are determined such that the elapsed time X is the "time when the toner ratio Tc in the toner image before the entrance is equal to or more than 70%".

It can be considered that depending on use conditions such as the thickness of the sheet and the details of the image (such as which one of color and monochrome is adopted and a print rate), the "time when the toner ratio Tc is equal to or more than 70%" differs. Hence, when the configuration, the operation and the like of the fixing device are determined, consideration is preferably given such that even under the most strict of the use conditions which can be assumed, the "time when the toner ratio Tc in the toner image before the entrance is equal to or more than 70%". In the present embodiment, in order for a more appropriate elapsed time X to be realized according to the use conditions, a plurality of operation modes corresponding to the use conditions (the operation is performed such that the elapsed time X differs in each of the operation modes) may be previously prepared such that they can be switched as necessary.

In the fixing device of the present embodiment, the penetration of the carrier liquid is appropriately performed, and thus it is possible to sufficiently reduce the offset. In the fixing device of the present embodiment having any one of the features in examples 4 to 9, the non-contact heating portion 6 is provided such that a plurality of infrared heaters 64 (non-contact heating units) which output radiant energy (mainly radiation) for the non-contact heating are aligned in the sheet transport direction. With respect to all or part of the infrared heaters 64 (conveniently referred to as "focused heating units"), the entrance direction in which radiant energy output from each of the focused heating units enters the sheet is inclined to the upstream side with respect to the direction vertical to the sheet.

Furthermore, the angle θ between the entrance direction and the vertical direction for each of the focused heating units is gradually decreased from the downstream side toward the upstream side. At least one of the angles θ is preferably equal to or more than 10°.

In the fixing device of the present embodiment having any one of the features in examples 4 to 6, all of the infrared heaters 64 included in the non-contact heating portion 6 correspond to the focused heating units. In the fixing device of the present embodiment having any one of the features in examples 7 to 9, all of the infrared heaters 64 included in the non-contact heating portion 6 other than the infrared heater 64 located in the most upstream position correspond to the focused heating units. In the infrared heater 64 located in the most upstream position, the direction in which the radiant energy is output coincides with the vertical direction.

Each of the focused heating units in the fixing device of the present embodiment having the features in examples 4 and 7 is arranged to be inclined such that the direction in which the radiant energy is output is inclined to the upstream side. Each of the focused heating units in the fixing device of the present embodiment having the features in examples 5 and 8 includes the heat source (the non-contact heater 61) and the reflective plate 63 which reflects radiant energy from the heat source, and the reflective plate 63 of each of the focused heating units is arranged to be inclined such that the direction in which the radiant energy is output is inclined to the upstream side.

In the fixing device of the present embodiment having the feature in example 6 or 9, the reflective plate 69 corresponding to each of the focused heating units is provided. Each of the reflective plates 69 is arranged so as to reflect the radiant energy output from the corresponding focused heating unit in a direction inclined to the upstream side.

Although the embodiment of the present invention has been described using the specific examples, the present invention is not limited to the details thereof. The present invention can be practiced so as to have various specific aspects without departing from the spirit thereof.

What is claimed is:

1. A fixing device that fixes, to a sheet, a toner image developed with a wet developer containing a toner and a carrier liquid, the fixing device comprising:

a non-contact heating portion that includes at least one non-contact heating unit which heats the toner image on the sheet in a non-contact manner; and a pressurizing and heating unit that is provided on a downstream side in a sheet transport direction with respect to the non-contact heating portion and that pressurizes and heats the toner image on the sheet, wherein a time elapsed since the toner image reached a toner melting temperature by heating of the non-contact heating portion until the toner image enters the pressurizing and heating unit is a time when a ratio between a weight of the toner in the toner image before the entrance and a sum of the weight of the toner and the weight of the carrier liquid is equal to or more than 70%.

2. The fixing device according to claim 1, wherein in the non-contact heating portion, a plurality of the non-contact heating units which output radiant energy for the non-contact heating are provided so as to be aligned in the sheet transport direction, and an entrance direction in which the radiant energy output from each of focused heating units that are all or part of the non-contact heating units enters the sheet is inclined to an upstream side in the sheet transport direction with respect to a direction vertical to the sheet.

3. The fixing device according to claim 2, wherein each of the focused heating units is arranged to be inclined such that the direction of the output is inclined to the upstream side.

4. The fixing device according to claim 2, wherein each of the focused heating units includes a heat source and a reflective plate that reflects radiant energy from the heat source, and the reflective plate of each of the focused heating units is arranged to be inclined such that the direction of the output is inclined to the upstream side.

5. The fixing device according to claim 2, wherein a reflective plate corresponding to each of the focused heating units is provided, and the reflective plate is arranged so as to reflect, in a direction inclined to the upstream side, the radiant energy output from the corresponding focused heating unit.

6. The fixing device according to claim 2, wherein an angle between the entrance direction and the vertical direction in each of the focused heating units is gradually decreased from the downstream side in the sheet transport direction toward the upstream side.

7. The fixing device according to claim 2, wherein at least one of angles between the entrance direction and the vertical direction in the focused heating units is equal to or more than 10 degrees.

8. The fixing device according to claim 2, wherein all the non-contact heating units are the focused heating units.

9. The fixing device according to claim 2, wherein all the non-contact heating units other than the non-contact heating unit located in a most upstream position in the sheet transport direction are the focused heating units.

10. The fixing device according to claim 9, wherein in the non-contact heating unit located in the most upstream position in the sheet transport direction among the non-contact heating units, the direction of the output substantially coincides with the vertical direction.

* * * * *